US006799647B2

(12) United States Patent
Clemmons

(10) Patent No.: US 6,799,647 B2
(45) Date of Patent: Oct. 5, 2004

(54) EARTH DRILLING AND BORING SYSTEM

(76) Inventor: Ricky Clemmons, 231 Haybert Ct., Bakersfield, CA (US) 93304

( * ) Notice: Subject to any disclaimer, the term of this patent is extended or adjusted under 35 U.S.C. 154(b) by 0 days.

(21) Appl. No.: 10/016,766

(22) Filed: Dec. 6, 2001

(65) Prior Publication Data

US 2003/0106715 A1 Jun. 12, 2003

(51) Int. Cl.[7] ..... E21B 7/04

(52) U.S. Cl. ..... 175/89; 175/113; 175/162; 175/220

(58) Field of Search ..... 175/19, 61, 62, 175/89, 90, 113, 114, 170, 162, 220, 323; 464/18, 21, 57, 58; 138/120; 254/29 R, 134 FT; 166/77.2, 63; 242/576.1; 15/104.33; 405/184.1

(56) References Cited

U.S. PATENT DOCUMENTS

| | | | | | |
|---|---|---|---|---|---|
| 2,810,439 | A | * | 10/1957 | Johnson et al. | 166/77.2 |
| 2,960,851 | A | * | 11/1960 | Ciaccio | 464/57 |
| 3,720,272 | A | | 3/1973 | Hunter | 175/61 |
| 3,777,827 | A | * | 12/1973 | Thiery et al. | 175/162 |
| 4,149,391 | A | * | 4/1979 | Driver | 464/21 |
| 4,522,125 | A | * | 6/1985 | Marz | 166/63 |
| 4,621,698 | A | | 11/1986 | Pittard | 175/305 |
| 4,856,600 | A | * | 8/1989 | Baker et al. | 175/162 |
| 4,858,704 | A | | 8/1989 | McDonald | 175/61 |
| 4,953,638 | A | | 9/1990 | Dunn | 175/61 |
| 4,957,173 | A | | 9/1990 | Kinnan | 175/61 |
| 4,981,181 | A | | 1/1991 | Hesse | 175/19 |
| 5,360,075 | A | * | 11/1994 | Gray | 175/162 |
| 5,671,811 | A | * | 9/1997 | Head | 166/77.2 |
| 5,813,482 | A | | 9/1998 | Barbera | 175/61 |
| 6,220,372 | B1 | * | 4/2001 | Cherry | 175/323 |

* cited by examiner

*Primary Examiner*—David Bagnell
*Assistant Examiner*—Matthew J. Smith
(74) *Attorney, Agent, or Firm*—Dennis W. Beech

(57) ABSTRACT

The earth drilling and boring system for drilling bore holes in the earth has a drilling rig with a power source attached to a rotateable pipe container. There is a flexible drill pipe or tubing attached to end retained in the pipe container that has an opening through which an end of the drill pipe or tubing having a drill bit attached may be extended and retrieved. A drive mechanism is positioned adjacent to the opening for receipt and movement of the drill pipe or tubing to be used in boring.

21 Claims, 5 Drawing Sheets

EARTH DRILLING AND BORING SYSTEM

BACKGROUND OF THE INVENTION

This invention relates to earth drilling and boring machines, systems and methods and more particularly to earth drilling systems that allow directional control of the drilling axis prior to and after earth entry for boring purposes. The new drilling system and method uses a flexible and rotateable drilling pipe or tube powered by a machine and having a drill bit.

Earth drilling and boring machines have been known for many years. Such machines and systems have been used to drill into the earth to gain access to oil, water and other resources as well as to create holes and bores to route man made elements such as gas lines, electrical or communication conduits and the like.

Earth drilling in a generally horizontal direction is also known. Such drilling is generally accomplished by use of a drilling machine that powers a rotating drill string or a pneumatic compression mole that is introduced at a slant angle to the earth to then be guided in an arcuate path to for example create a borehole under a roadway or a building. This method requires sufficient space on either side of a structure to allow drilling at a slant angle.

An alternative used in situations where sufficient space does not exist is to trench adjacent the structure, e.g., roadway, and locate a drilling machine in the trench. Short lengths of pipe may be joined in sequence as the boring operation proceeds through the earth. This operation may be time consuming and inefficient as compared to the slant angle drilling methods.

SUMMARY OF THE INVENTION

The present invention is directed to systems and methods for drilling boreholes in the earth having a drilling rig with a power source attached to a rotateable pipe or tube container. A drill pipe or tube may be attached to and retainable in the rotateable pipe container that also may have an aperture therein through which an end of the drill pipe or tube may be extended and retrieved. A drill bit may be attached to an end of the drill pipe or tube. A drive mechanism may be positioned adjacent to the aperture for receipt and movement of the drill pipe or tube therethrough.

These and other features, aspects and advantages of the present invention will become better understood with reference to the following drawings, description and claims.

DETAILED DESCRIPTION

The following detailed description is the best currently contemplated modes for carrying out the invention. The description is not to be taken in a limiting sense, but is made merely for the purpose of illustrating the general principles of the invention.

Figure 1:
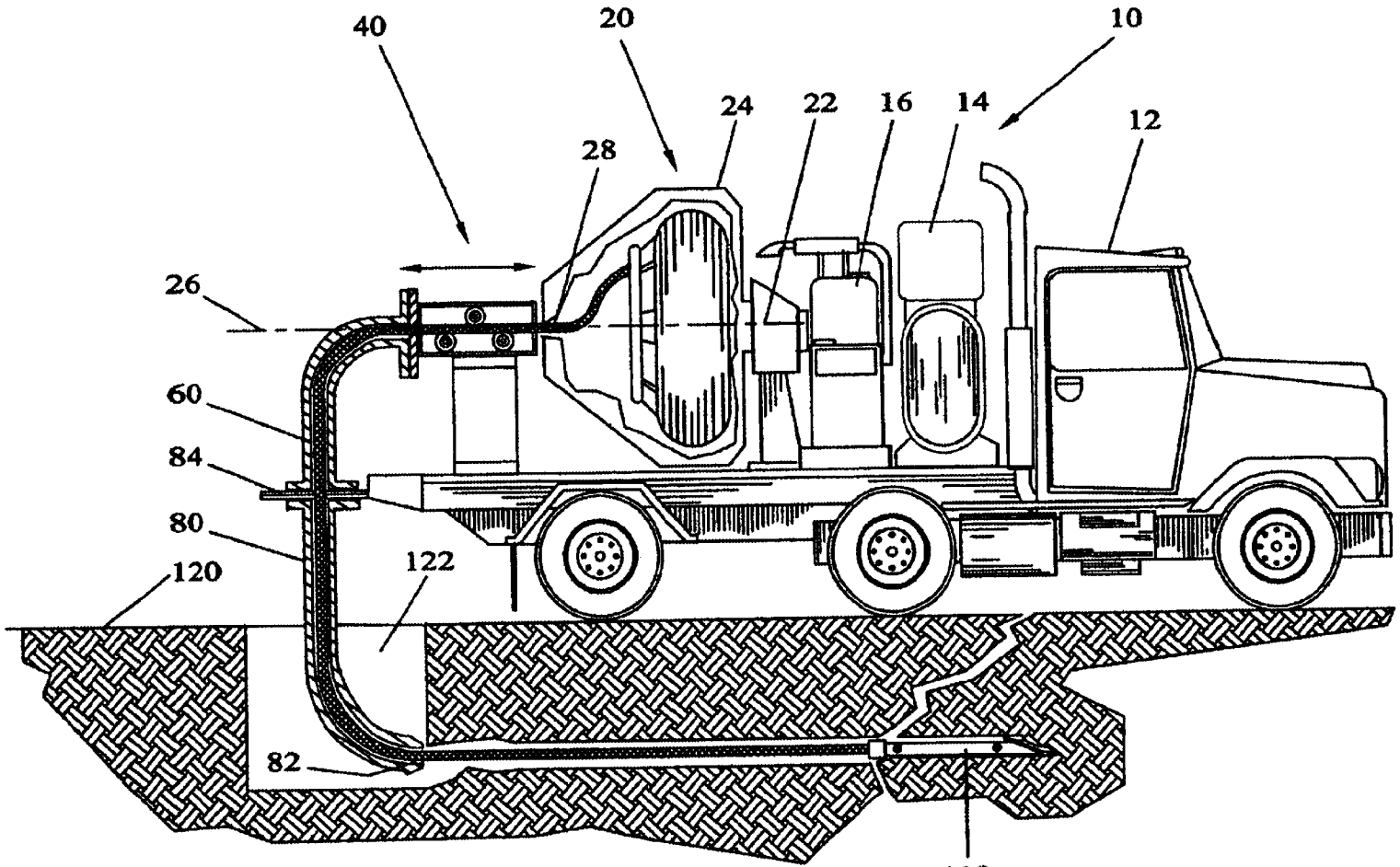
FIG. 1 illustrates a schematic side elevation representation of a drilling rig in use for drilling a horizontal borehole.

Referring to FIG. 1, a drilling rig 10 may include a transport vehicle 12 with drilling fluid equipment 14, power source 16 and drilling machine 20 installed thereon. The drilling machine 20 may have rotation support 22 supporting pipe container 24 that may be rotated about axis 26 by power source 16. A drill pipe 60 may be contained in and extend from the pipe container 24 through aperture 28. The pipe container 24 structure supportable of drill pipe 60 coiled in the pipe container 24 such that the axis 28 of rotation of the pipe container 24 may be approximately horizontal to a drilling surface or earth surface 120. While pipe may be used as a general descriptor, it will be understood by those skilled in the art that this may include flexible drill pipe. tubing end the like.

A drill pipe drive mechanism 40 may be positioned rearward of aperture 28. Drill pipe 60 may be moved through the drive mechanism 40 in a forward or rearward direction. As the drill pipe 60 is moved through the drive mechanism 40 in a rearward direction the drill pipe 60 may be routed through a conduit 80 to guide it to drill in for example a horizontal direction in the earth 100. As drilling progresses drill pipe 80 may be supplied from pipe container 24.

The conduit 80 may be attached rearward of the drive mechanism 40 and positioned to have a drilling end 82 located in a trench 122, hole or other prepared entry opening for horizontal drilling in the earth 120. The conduit 80 may also have a rotation connector 84 that may be attached to the vehicle 12 to aid in initial guiding of the drill pipe 60 and drill bit 110. While a generally horizontal rotation connector 84 is illustrated, other connection joints may be used as for example a three dimensional universal rotation connector (not shown). Also, the drilling end 82 of the conduit 80 may have other directional orientations than the illustrated generally horizontal drilling direction.

The drill bit 110 may be a directional drill bit with a slanted or spade front surface element to aid in changing direction when drilling in the earth. When the drill pipe 60 is not rotating the drill bit 110 may be urged forward using drilling fluid and drive mechanism 40. The slanted front surface of the drill bit 110 may cause the drill bit 110 to move away from the previous boring axis. When the drill pipe 60 is rotating the drill bit 110 may tend to bore in a straight line axis. Also, a mud motor apparatus may be used for applying rotational torque to a drill bit by hydraulic action. The pumping of drilling fluid through the tubing 92 causes rotation of the drill bit without rotating the drill string or tubing 92. The tubing 92 may be rotated for directional steering, see FIG. 10. A mud motor has a slight bend in it that may cause turning as the drill bit progresses through the earth.

Figure 2:
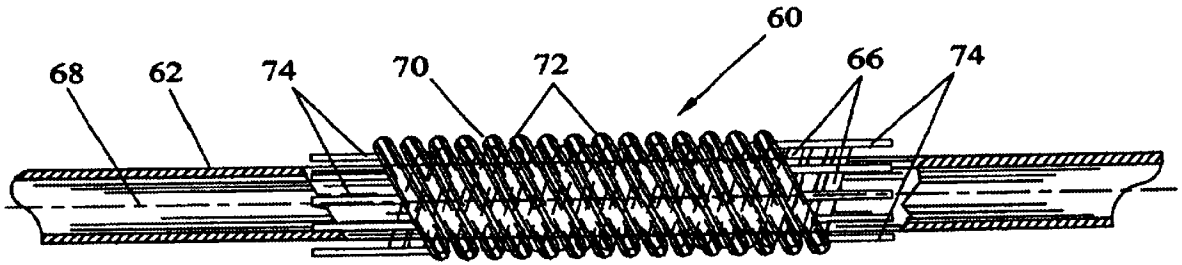
FIG. 2 illustrates a partial sectional view of a drill pipe.
Figure 3:
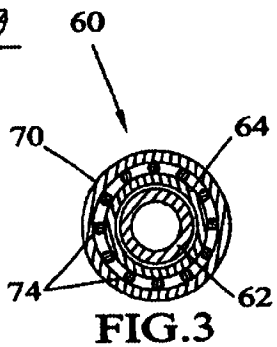
FIG. 3 illustrates an end cross-sectional view of a drill pipe.
Figure 4:
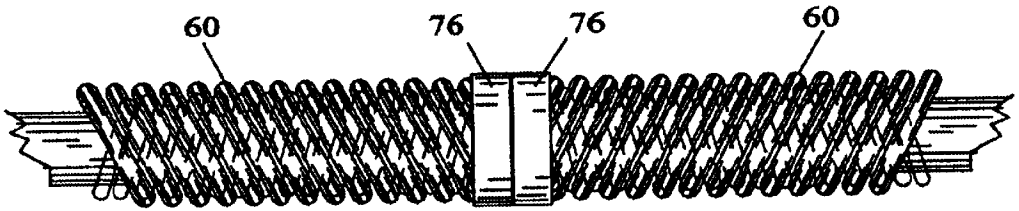
FIG. 4 illustrates a partial sectional view of a drill pipe with sectional coupling.

Referring to FIGS. 2 through 4, a drill pipe 60 may have an inner conduit 62 for flow of fluid, such as, drilling mud, under pressure to aid in drill bit 80 cutting as such cutting is understood in the art. A wire coil 64 may be located coaxially around the inner conduit 62. The wire coil 64 may have coil elements 66 oriented at an angle other than orthogonal to the drill pipe axis 68. As illustrated in FIG. 2 the coil elements 66 are oriented at an approximate 70 degree angle from the drill pipe axis 68.

A second wire coil 70 may be located coaxially around the wire coil 64. The second wire coil 70 may have second coil elements 72 oriented at an angle other than orthogonal to the drill pipe axis 68. As illustrated in FIG. 2 the second coil elements 72 are oriented at an approximate 110 degree angle from the drill pipe axis 68 as measured in the same angular rotation as coil elements 66.

Wire 74, flexible metal rods or the like may be positioned intermediate the wire coil 64 and second wire coil 70 that may provide additional longitudinal support for drill pipe 60. The wire coils 62, 70 and the wire 74 may be attached along the longitudinal length by for example welding or other appropriate attachment methods. The drill pipe elements 62, 66, 70, 74 may be fastened in a coupling 76 at each end thereof. The couplings 76 may be used for attachment of a drill bit, for attachment to a pipe container and for attachment to the output of a drilling fluid equipment system. The couplings 76 may also be used to connect two sections of drill pipe as illustrated in FIG. 4.

Figure 5:
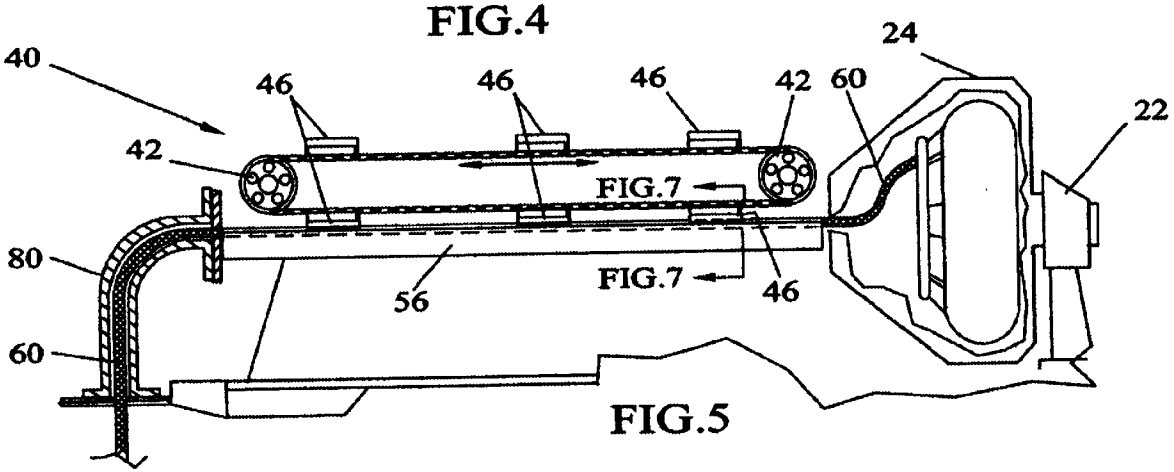
FIG. 5 illustrates a schematic side view of a drill pipe drive mechanism.
Figure 6:
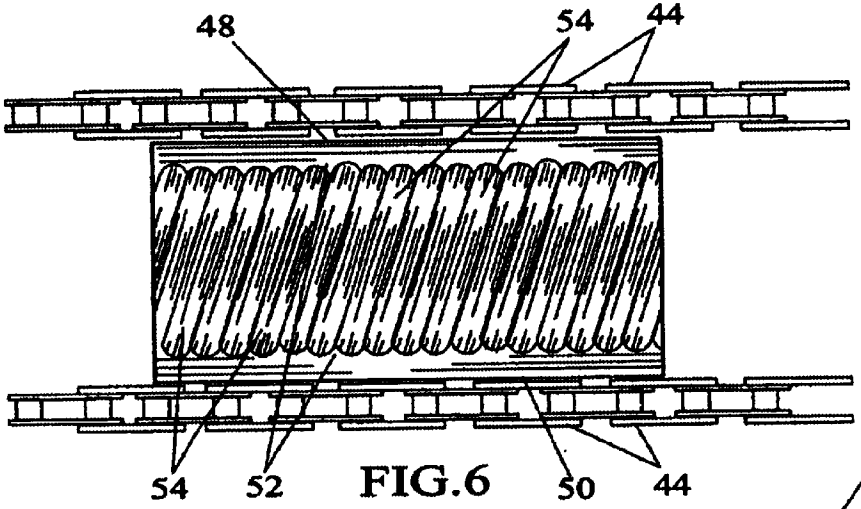
FIG. 6 illustrates a schematic partial view of a drill pipe drive mechanism and drill pipe.
Figure 7:
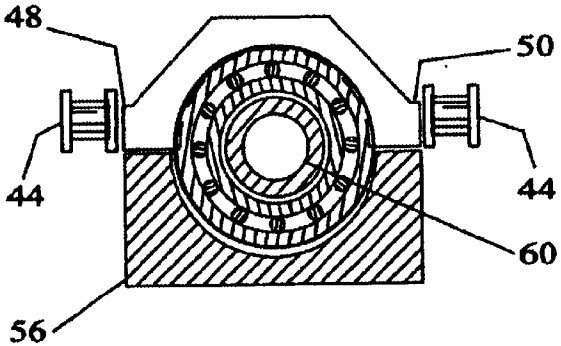
FIG. 7 illustrates an end cross-sectional view of a drill pipe drive mechanism and drill pipe.

Referring to FIGS. 5 through 7, a drill pipe drive mechanism 40 may have a pair of rotating gear mechanisms 42 that engage and drive a pair of continuous loop chains 44. Drive blocks 46 may be attached at sides 48, 50 thereof between chains 44. The drive blocks 46 may have a pipe trough 52 with ridges 54 for engaging the coil elements or second coil elements of a drill pipe 60 to be moved through the drive mechanism 40. The drill pipe 60 may be supported for movement through the drive mechanism 40 by a guide trough 56 positioned opposite the path of the drive blocks 46.

In operation, when the gear mechanism 42 is rotated to move chains 44 and drive blocks 46, the drill pipe 60 may be moved through the drive mechanism 40 by engagement of the ridges 54 in drill pipe 60. When the pipe container 24 is rotated, as for example, to rotate the drill pipe 60 and drill bit 90 to cut into the earth, the movement of the drive mechanism 40 may be synchronized with the rotation of the pipe container 24 to inhibit retraction of the drill pipe 60 into the pipe container 24. The drive mechanism 40 may also be operated at a speed during any such rotation motion to urge the drill pipe 60 and drill bit 90 forward into the earth to advance the bore hole formation. When desired, the drive mechanism 40 may be operated to retract the drill pipe 60.

Figure 8:
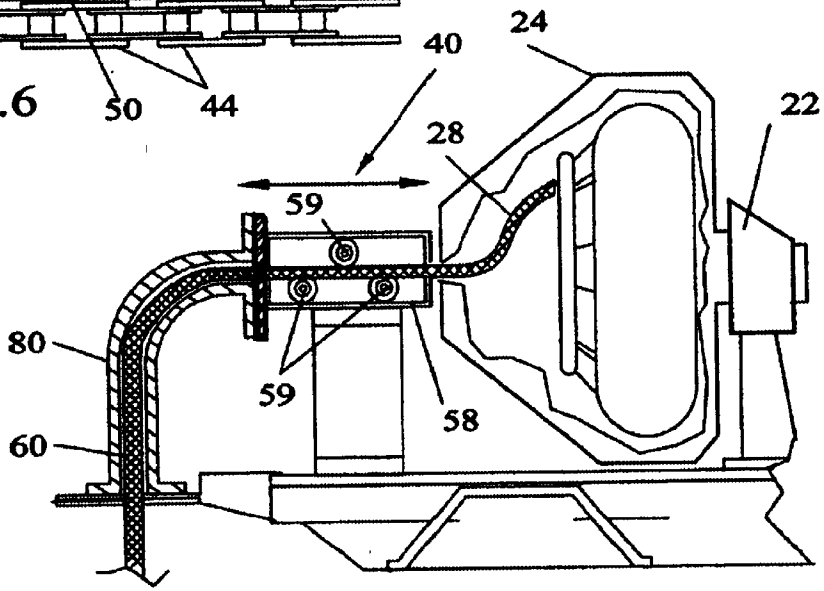
FIG. 8 illustrates a schematic side view of a drill pipe drive mechanism according to an embodiment of the invention.

Referring to FIG. 8, a drill pipe drive mechanism 40 may have a rotating gear mechanism 58 to move the drill pipe 60 therethrough. The gear elements 59 may have gear teeth (not shown) that engage the coil elements of the drill pipe 60. Movement and synchronization would be similar to that described above.

Figure 9:
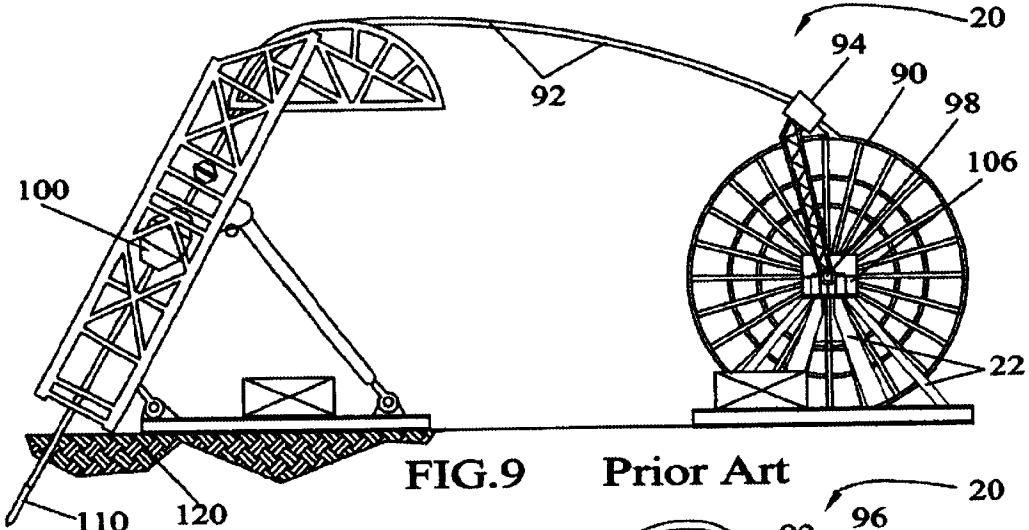
FIG.9 Prior Art
FIG. 9 illustrates a schematic side elevation representation of a prior art drilling machine.

While the invention has been shown and described using a drill pipe 60 having one or more wire coils, other flexible drilling pipe or tubing may be used. Referring to FIG. 9, a conventional drilling machine 20 has a reel 90 on which coiled steel tubing 92 may be wound as commonly understood by those skilled in the art. The tubing 92 is routed through a tube guide 94 that may be supported by a tube guide support 96 attached to the reel axis 98. As the tubing 92 is unwound it may be guided through and moved by an injector unit 100 for drilling into the earth. The tubing 92 may have a hydraulic or jet spray drill bit 110 attached thereto.

Coiled steel tubing 92 may also be used in the drilling machine 20 illustrated in FIG. 1. The drive mechanism 40 may be modified to facilitate movement of the tubing 92 in a rearward and forward direction by use of an injector unit 100 or a variation thereof.

Figure 10:
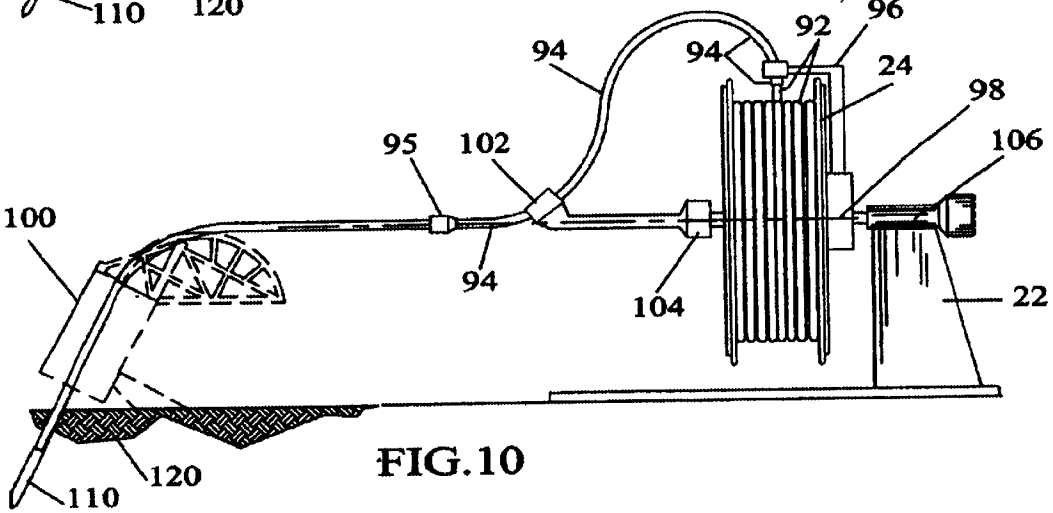
FIG. 10 illustrates a schematic side elevation representation of a drilling machine according to an embodiment of the invention.
Figure 11:
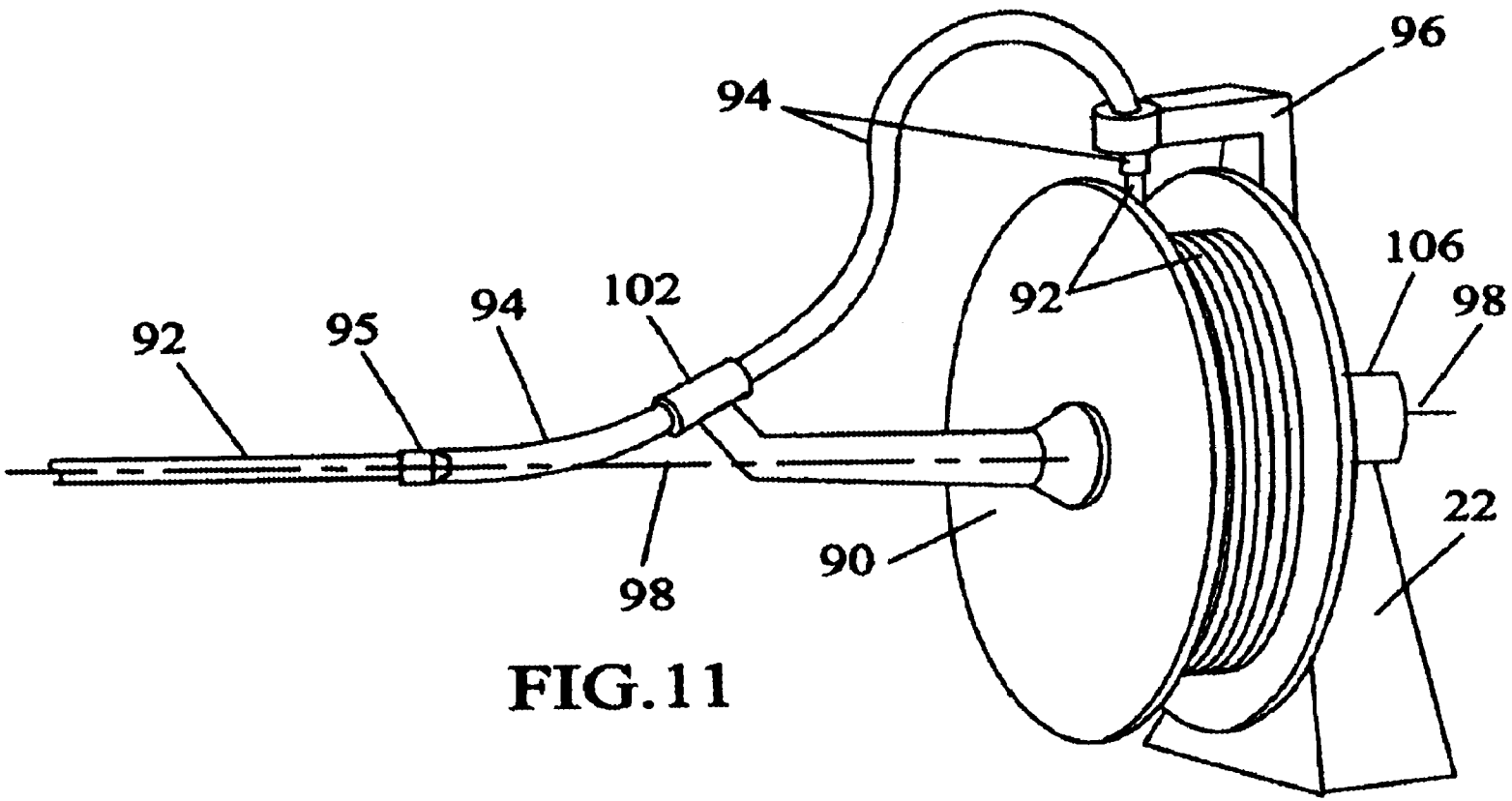
FIG. 11 illustrates a partial schematic perspective side elevation view of the drilling machine taken at line A—A of FIG. 10 according to an embodiment of the invention.

Referring to FIGS. 10 and 11, the drive mechanism 40 may be replaced with a reel 90 and appropriate reel support 22 elements as well as fluid connection to the drilling fluid equipment 14 and power source 16 illustrated in FIG. 1. A tube guide 94 may be structured to guide the tubing 92 from the reel 90 to exit the tube guide 94 at tube aperture 95 coincident with the reel axis 98. The tube guide 94 may be supported by a guide support arm 102. The guide support arm 102 and tube guide support 96 may be attached to the reel axis 98 by rotating coupling 104 located with a reel mount 106. The tubing 92 may be unreeled and moved by drive mechanism or injector unit 100 to drill into the earth. When it is desired to change the drilling direction the tube guide 94 may be rotated by engaging rotating coupling 104 to lock reel 90 and tube guide 94. Rotating the reel 90 may cause the tube guide 94 and tubing 92 to rotate thereby causing the drill string and drill bit 110 to rotate and change the down hole orientation.

Referring to FIGS. 2 through 4, the drill pipe 60 may be fabricated in lengths for use with rigid steel drill pipe (not shown). The drill pipe 60 may then be inserted in a drill pipe string to add flexibility to such drill pipe string. Drill pipe 60 may also be used to form larger portions of a drill pipe string for down hole drilling flexibility.

While the invention has been particularly shown and described with respect to the illustrated and preferred embodiments thereof, it will be understood by those skilled in the art that the foregoing and other changes in form and details may be made therein without departing from the spirit and scope of the invention.

I claim:

1. A system for drilling bore holes in the earth comprising:

a drilling rig having a power source attached to a rotateable pipe container;

a drill pipe that is flexible and is attached to and retainable in said rotateable pipe container;

said rotateable pipe container having an aperture therein and an axis of rotation oriented to rotate said drill pipe about a longitudinal axis when an end of said drill pipe may be extended and retrieved through said aperture;

a drill bit attached to said end of said drill pipe; and a drive mechanism adjacent to said aperture for receipt and movement of said drill pipe therethrough.

2. The system as in claim 1 wherein said drill pipe comprising:

an inner conduit having a wire coil located coaxially around said inner conduit.

3. The system as in claim 2 wherein said wire coil having a plurality of wire coil elements oriented at an angle non-orthogonal to a drill pipe axis.

4. The system as in claim 3 wherein a second wire coil is located coaxially around said wire coil.

5. The system as in claim 4 wherein said second wire coil having a plurality of second wire coil elements oriented at an angle nonorthogonal to said drill pipe axis.

6. The system as in claim 5 wherein there is a plurality of wires positioned intermediate said coil element and said second coil element and said wires are oriented generally longitudinally relative to said drill pipe axis.

7. The system as in claim 6 wherein said drill pipe has a coupling attached at each end.

8. The system as in claim 1 wherein said drive mechanism comprising:

a rotating gear mechanism driving a generally continuous loop chain;

a plurality of drive blocks attached at each side to said loop chain;

each drive block having a pipe trough formed therein with a plurality of ridges formed therein for engagement with a wire coil of said drill pipe; and a guide trough positioned opposite said drive blocks.

9. The system as in claim 1 wherein there is a conduit positioned adjacent said drive mechanism for receipt of said drill pipe.

10. The system as in claim 9 wherein said conduit having a rotation connector.

11. The system as in claim 1 wherein said drive mechanism comprising:

a plurality of rotating gear mechanisms positioned for engagement with a wire coil of said drill pipe to move said drill pipe through said drive mechanism.

12. The system as in claim 1 wherein said drill pipe comprising a coiled flexible tubing.

13. The system as in claim 12 wherein said rotateable pipe container is a reel and said aperture is located in a tube guide having a tube aperture at an end thereof.

14. The system as in claim 13 wherein said tube guide is supported by a tube guide support attached to said reel at a reel axis and a guide support arm attached to said reel axis.

15. The system as in claim 14 wherein said tube guide support and said guide support arm are attached to said reel axis by a rotating coupling.

16. The system as in claim 12 wherein said drive mechanism is an injector unit.

17. A system for drilling bore holes in the earth comprising:

a drilling rig having a power source attached to a rotateable pipe container;

a drill pipe that is flexible and is attached to and retainable in said rotateable pipe container, and said rotateable pipe container having an aperture therein through which an end of said drill pipe may be extended and retrieved;

a drill bit attached to said end of said drill pipe; and a drive mechanism adjacent to said aperture for receipt and movement of said drill pipe therethrough wherein said drive mechanism comprising:

a rotating gear mechanism driving a generally continuous loop chain;

a plurality of drive blocks attached at each side to said loop chain;

each drive block having a pipe trough formed therein with a plurality of ridges formed therein for engagement with a wire coil of said drill pipe; and a guide trough positioned opposite said drive blocks.

18. A system for drilling bore holes in the earth comprising:

a drilling rig having a power source attached to a rotateable pipe container;

a drill pipe that is flexible comprising an inner conduit, a wire coil having a plurality of wire coil elements oriented at an angle nonorthogonal to a drill pipe axis located coaxially around said inner conduit, a second wire coil having a plurality of second wire coil elements oriented at an angle nonorthogonal to said drill pipe axis located coaxially around said wire coil, and a plurality of wires positioned intermediate said coil element and said second coil element and said wires are oriented generally longitudinally relative to said drill pipe axis;

said drill pipe attached to and retainable in said rotateable pipe container, and said rotateable pipe container having an aperture therein through which an end of said drill pipe may be extended and retrieved;

a drill bit attached to said end of said drill pipe; and a drive mechanism adjacent to said aperture for receipt and movement of said drill pipe therethrough wherein said drive mechanism comprising:

a rotating gear mechanism driving a generally continuous loop chain;

a plurality of drive blocks attached at each side to said loop chain;

each drive block having a pipe trough formed therein with a plurality of ridges formed therein for engagement with a wire coil of said drill pipe; and a guide trough positioned opposite said drive blocks.

19. A system for drilling bore holes in the earth comprising:

a drilling rig having a power source attached to a rotateable pipe container comprising a reel having a tube guide supported by a tube guide support attached to said reel at a reel axis and a guide support arm attached to said reel axis, and said tube guide support and said guide support arm are attached to said reel axis by a rotating coupling;

a drill pipe comprising a coiled flexible tube that is attached to and retainable in said rotateable pipe container, and said tube support guide having an aperture therein through which an end of said drill pipe may be extended and retrieved;

a drill bit attached to said drill pipe; and a drive mechanism adjacent to said aperture for receipt and movement of said drill pipe therethrough.

20. The system as in claim 19 wherein there is a conduit positioned adjacent said drive mechanism for receipt of said drill pipe.

21. The system as in claim 20 wherein said conduit having a rotation connector.

* * * * *